US007974544B2

(12) United States Patent
Kobayashi et al.

(10) Patent No.: US 7,974,544 B2
(45) Date of Patent: Jul. 5, 2011

(54) ELECTROPHOTOGRAPHY APPARATUS HAVING EDGE DETECTION OF TONER PATCH AND EXPOSURE CONTROL

(75) Inventors: Shinya Kobayashi, Ibaraki (JP); Takeshi Shibuya, Kanagawa (JP)

(73) Assignee: Ricoh Company, Tokyo (JP)

( * ) Notice: Subject to any disclaimer, the term of this patent is extended or adjusted under 35 U.S.C. 154(b) by 299 days.

(21) Appl. No.: 12/395,829

(22) Filed: Mar. 2, 2009

(65) Prior Publication Data

US 2009/0220264 A1 Sep. 3, 2009

(30) Foreign Application Priority Data

Mar. 3, 2008 (JP) ..... 2008-052269
Sep. 16, 2008 (JP) ..... 2008-236595

(51) Int. Cl.
*G03G 15/00* (2006.01)

(52) U.S. Cl. ..... 399/49; 399/51

(58) Field of Classification Search ..... 399/49, 399/51, 72; 358/3.15; 382/266
See application file for complete search history.

(56) References Cited

U.S. PATENT DOCUMENTS 5,884,119 A * 3/1999 Maruo et al. ..... 399/51
6,181,438 B1 * 1/2001 Bracco et al. ..... 358/1.9
6,700,595 B2 * 3/2004 Sugiyama et al. ..... 347/133
7,006,244 B2 * 2/2006 Loce ..... 358/1.2
7,054,014 B2 * 5/2006 Foster et al. ..... 358/1.1
7,064,866 B1 * 6/2006 Asada ..... 358/2.1
7,412,108 B2 * 8/2008 Keithley ..... 382/254
2007/0279695 A1 * 12/2007 Kouzaki et al. ..... 358/3.06

FOREIGN PATENT DOCUMENTS

JP 11-305517 11/1999
JP 2002-236402 8/2002
JP 3373556 11/2002
JP 2003-98773 4/2003
JP 3479447 10/2003
JP 3570463 7/2004
JP 2005-77685 3/2005
JP 2006-276422 10/2006

* cited by examiner

*Primary Examiner* — Robert Beatty
(74) *Attorney, Agent, or Firm* — Oblon, Spivak, McClelland, Maier & Neustadt, L.L.P.

(57) ABSTRACT

An electrophotography apparatus prevents the edge effect without causing the blurring or loss of a single-dot image or a single-dot-width line. Based on a measurement of a testing patch, two templates with different sizes are generated. Image data to be printed is subjected to template matching using the templates to obtain a difference region as an image edge region of the image data where, when the image data is developed, the amount of attached toner is increased. The exposure amount for the image edge region is controlled based on a measurement of the amounts of attached toner in edge portions of the testing patch so that the difference in the attached toner amounts are minimized.

7 Claims, 13 Drawing Sheets

ELECTROPHOTOGRAPHY APPARATUS HAVING EDGE DETECTION OF TONER PATCH AND EXPOSURE CONTROL

BACKGROUND OF THE INVENTION

1. Field of the Invention

The present invention relates to electrophotography apparatuses, such as printers, copy machines, and facsimiles.

2. Description of the Related Art

As a result of the growing demand for producing documents in color at high speed, color printers are becoming increasingly common. For example, a color electrophotography apparatus is known in which a black toner and toners for the colors yellow, magenta, and cyan are used. Toner images formed by image forming units for the individual colors are transferred onto an intermediate transfer member, and a resultant toner image with the overlaid colors is transferred to and then fused on a recording medium, thereby obtaining a color image.

In this type of electrophotography apparatus, in order to obtain stable image quality in terms of image density and the like, image forming conditions are controlled by forming a plurality of testing solid patches on the intermediate transfer member under predetermined image forming conditions, and the amounts of toner attached in the patches are detected by an optical sensor.

Patent Documents 1 and 2 disclose methods for measuring the attached toner amounts. When measuring the amount of attached black toner, which absorbs light well and produces little scattered light, a method is used that utilizes a specular reflection output (Vreg) of a photoreceiving element on which specular reflection light is incident.

This method, however, is not suitable for measuring the attached amounts of color toners because the color toners produce much scattering of light and, as the attached toner amount increases, a scattered light component in the specular reflection output Vreg increases. Thus, a method is employed that uses an additional photoreceiving element on which diffusive reflected light alone is incident. In this method, a diffusive reflection output (Vdif) is measured simultaneously, and the scattered light component contained in the specular reflection output Vreg is removed on the basis of the diffusive reflection output.

Nevertheless, even with the use of the specular reflection output Vreg from which the scattered light component is removed as discussed in Patent Document 1, the upper limit of the measurable range of attached toner amount is no more than approximately one full layer of toner. Above that, the specular reflection output Vreg saturates and cannot be measured. Normally, the attached toner amount of a solid image that is set in an actual printing operation is in the saturation region and cannot be measured. Thus, a method is used by which large attached amounts outside the measurable range are estimated from a measurable low range of attached amount in view of the development characteristics and the like.

With regard to the measurement of the attached amounts of color toners, the diffusive reflection output Vdif may be corrected with reference to attached toner amount data in a low attached-amount range that can be measured by the specular reflection output Vreg. Then an attached toner amount may be calculated from the corrected diffusive reflection output, using an attached toner amount conversion table for diffusive reflection. In this way, the high-density attached amounts in solid images can be determined.

There are two kinds of the testing toner patches that are conventionally used: one is a solid patch formed by solid exposure; and the other is a halftone patch for which exposure is turned on and off repeatedly in order to form a halftone image, such as a halftone dot image.

The solid patch is used for controlling the attached toner amount in a solid image region within a recorded image. For example, a number of the solid patches are formed while varying the developing bias potential as an image forming condition, and their attached toner amounts are measured with an optical sensor. In this way, a developing bias potential for obtaining a desired attached amount for a solid image can be determined.

On the other hand, the halftone patch is used for controlling the attached toner amount in a halftone dot or grey level image region within a recorded image. For example, multiple halftone patches are formed while varying a laser output as an image forming condition, and their attached toner amounts are measured with an optical sensor. In this way, a laser output for obtaining a desired attached toner amount can be determined.

The size of such testing toner patches is normally on the order of 10 mm×10 mm. The attached toner amount in an edge region within 0.3 to 0.6 mm of the image edge is typically larger than the attached toner amount in the inner region of the testing patch. This is due to a long-known phenomenon referred to as a fringing field effect, or the edge effect.

In accordance with the related art disclosed in Patent Documents 1 and 2, only the inner, central region of the testing toner patch is measured and controlled, so that the attached toner amount in the aforementioned edge region cannot be controlled to a desired value (which is normally the same as the attached toner amount in the inner region). This problem has been overcome by the related art as follows.

Patent Documents 3 and 4 disclose that a halftone patch is formed, and the amount of attached (developed) toner in the image edge portion is measured. The edge portions of a halftone dot image, a thin line image, and a solid image are recognized by pattern recognition technology, and the amount of exposure or the like is selectively changed within the image in order to reduce the edge effect. Patent Document 5 discloses that, after measuring an attached toner amount, the exposure amount or the like is modulated using a spatial digital filter instead of pattern recognition technology, so that the attached toner amount within the image edge portion can be corrected.

Patent Document 1: Japanese Laid-Open Patent Application No. 2005-77685

Patent Document 2: Japanese Laid-Open Patent Application No. 2002-236402

Patent Document 3: Japanese Laid-Open Patent Application No. 2003-98773

Patent Document 4: Japanese Patent No. 3479447

Patent Document 5: Japanese Patent No. 3373556

When the technologies according to Patent Documents 3 and 4 are applied to a high-speed electrophotography apparatus, the following problems arise.

First, a single-dot image or a line with a single-dot width either becomes blurred or may not be recorded at all. This is because, although the electric field intensity tends to enhance the edges during development due to the edge effect, this does not necessarily result in a corresponding amount of toner that is developed. Rather, in a high-speed machine, the attached toner amount in a region up to about 0.1 mm from the image edge is smaller than in the central portion. The attached toner amount increases from the aforementioned region and reaches a maximum (peak) attached toner amount at around 0.2 mm from the image edge. The attached toner amount then decreases further within, until it becomes the same as the attached toner amount at the central portion.

It goes without saying that the peak position or amount of attached toner differs among the edge portions upstream, downstream, and at the sides of the patch. Thus, when the conventional art is used, what little small amount of attached toner of a single-dot image or a single-dot-width line decreases even more, resulting in a blurred image or no image at all.

Another problem is that it is difficult with high-speed machines to accurately control the amount of exposure from a laser light source in multiple levels. This is due to the fact that their laser modulating speed is too fast. Thus, in the case of a high-speed apparatus, appropriate exposure intensities cannot be set for the upstream, downstream, side, and 45°-inclined edge portions of a solid image individually as shown in FIG. 7 of Patent Document 4. Further, exposure intensity cannot be accurately modulated based on an output of a digital filter as disclosed in Patent Document 5; the conventional exposure intensity may be reduced stably by only one level.

Because a halftone dot image is normally highly accurately density-controlled in a gradation process by an upper-level controller, image quality may deteriorate if the exposure intensity for an edge portion of the halftone dot image is inaccurately modulated. Thus, the edge control for halftone dot images should be left to the gradation process by the upper-level controller, and the edges of solid images alone should be corrected using the conventional art.

SUMMARY OF THE INVENTION

It is a general object of the present invention to provide an electrophotography apparatus in which one or more of the aforementioned problems of the related art are eliminated.

A more specific object of the present invention is to provide an electrophotography apparatus in which the edge effect can be controlled without causing the blurring or disappearance of a single-dot image or a single-dot-width line.

Another object is to provide an electrophotography apparatus in which the edge effect is not controlled in a peripheral portion of a halftone dot image.

According to one aspect of the present invention, an electrophotography apparatus includes a template matching circuit configured to determine an image region in an image to be recorded based on original image data from an upper-level controller; a pulse width modulation circuit configured to generate image data in which the image data is pulse-width modulated based on a result of the determination made in the template matching circuit; an exposing unit configured to perform exposure based on the image data modulated by the pulse width modulation circuit; a toner image carrier configured to carry a toner image based on an electrostatic latent image formed by the exposing unit; a testing patch forming unit configured to form a toner image of a testing patch on the toner image carrier; an attached toner amount measuring unit configured to measure an amount of toner attached in the testing patch toner image from a front edge to a rear edge thereof; a testing patch edge detecting unit configured to detect an edge portion of the testing patch toner image where the attached toner amount is greater than in other portions of the testing patch toner image; a template generating unit configured to generate, based on the edge portion detected by the testing patch edge detecting unit, two kinds of templates having different sizes by determining a number of pixels between a reference pixel position and each of upper, lower, left, and right edges; an edge pixel region calculating unit configured to perform template matching on the image data to be printed using the templates, wherein a smaller region detected by the larger template is subtracted from a larger region detected by the smaller template to calculate a difference region as an edge pixel region of the image data; and an exposure amount setting unit configured to set an exposure amount for an electrostatic latent image portion corresponding to the edge pixel region.

The exposure amount for the edge pixel region of the original image data is controlled based on the exposure amount set by the exposure amount setting unit.

BRIEF DESCRIPTION OF THE DRAWINGS

These and other objects, features and advantages of the invention will be apparent to those skilled in the art from the following detailed description of the invention, when read in conjunction with the accompanying drawings in which.

DETAILED DESCRIPTION OF THE PREFERRED EMBODIMENTS

Figure 1:
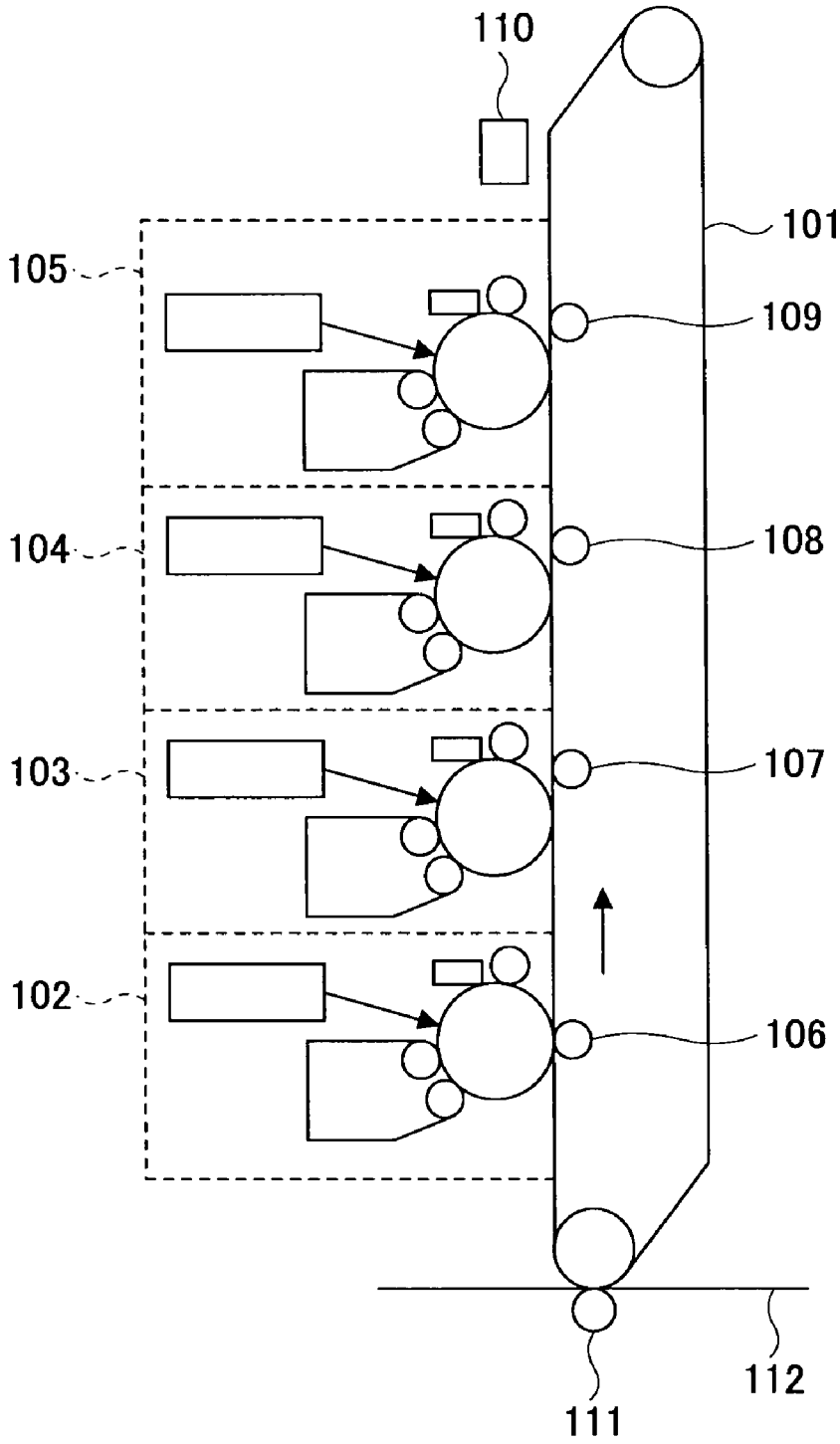
FIG. 1 shows an engine portion of a color electrophotography apparatus according to an embodiment of the present invention.

In the following, embodiments of the present invention are described with reference to the drawings. FIG. 1 shows an engine portion of a color electrophotography apparatus according to an embodiment of the present invention.

FIG. 1 shows a belt-shaped intermediate transfer member 101, a first image forming unit 102 for black (K), a second image forming unit 103 for yellow (Y), a third image forming unit 104 for magenta (M), and a fourth image forming unit 105 for cyan (C). Transfer units 106 through 109 are disposed at positions corresponding to the image forming units 102 through 105. An optical sensor 110 is configured to detect an amount of attached toner. The optical sensor 110 is disposed near the fourth image forming unit 105 in the final stage and downstream of the direction of rotation of the intermediate transfer member 101.

Figure 2:
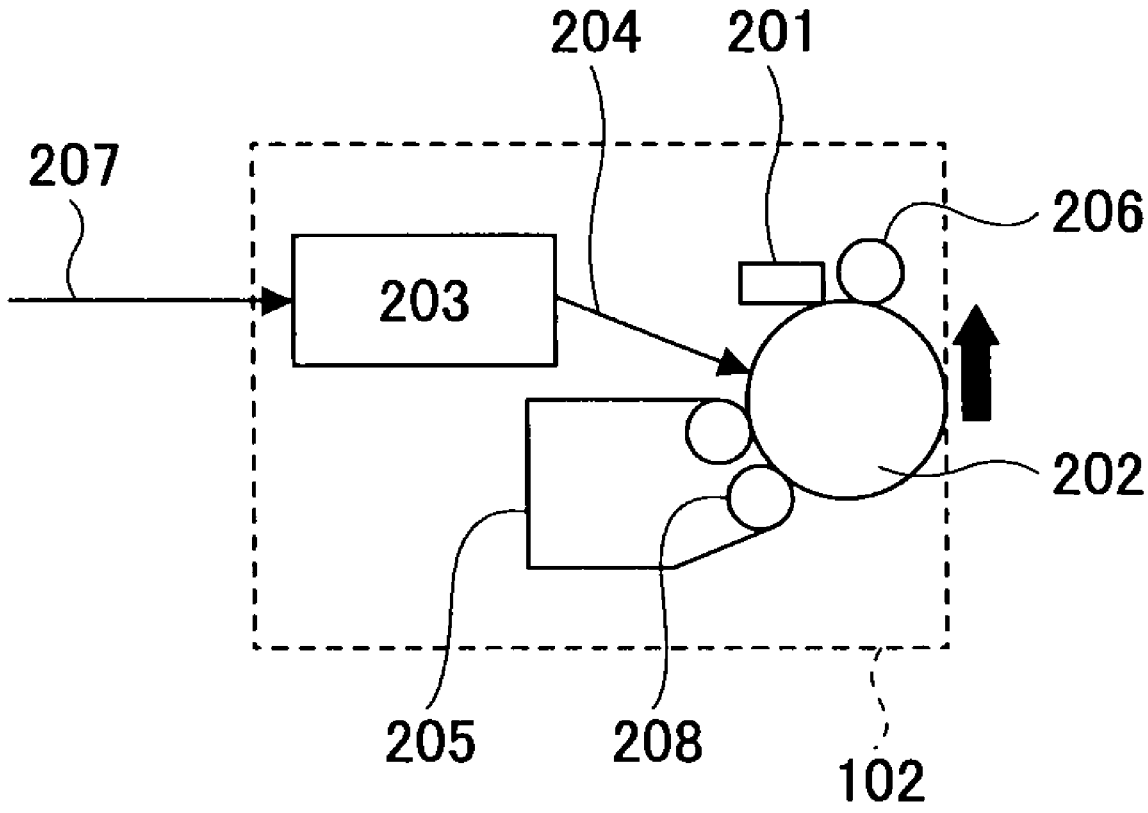
FIG. 2 shows a schematic diagram of an image forming unit of the electrophotography apparatus.

FIG. 2 schematically shows the image forming unit 102. The image forming unit 102 includes a charger 201, a photosensitive member 202, an exposing unit 203, a developing unit 205, and a photosensitive member cleaner 206.

In the image forming unit 102, initially a surface of the photosensitive member 202, which may include a negatively charged OPC (organic photoconductor) material, is uniformly charged by the charger 201. Then, the photosensitive member 202 is irradiated with a laser light 204 emitted by the exposing unit 203 in accordance with image data 207 from an upper-level controller (not shown), thereby forming an electrostatic latent image on the photosensitive member 202. The image data 207 is adapted for the color and timing of the image forming unit 102.

A toner of a predetermined color is supplied from the developing unit 205 to the electrostatic latent image formed on the photosensitive member 202, whereby a toner image is formed. The developing unit 205 contains a 2-component developing agent as toner material. The toner is caused to attach to the electrostatic latent image on the photosensitive member 202 via an internal developing roll 208 by a magnetic brush developing method.

The toner image formed on the photosensitive member 202 is transferred onto the intermediate transfer member 101 by the transfer unit 106 (see FIG. 1). The toner that remains on the photosensitive member 202 without being transferred onto the intermediate transfer member 101 is collected by the photosensitive member cleaner 206.

Similarly, in each of the image forming units 103 through 105 supplied with the toners of different colors, a toner image is formed on the individual photosensitive member 202. The toner images of the individual colors are then transferred onto the intermediate transfer member 101 via the transfer units 107 through 109. Finally, the color toner image is transferred onto a recording medium 112 by a transfer unit 111, followed by fusing of the color toner image on the recording medium 112 by a fusing unit (not shown), thereby completing a sequence of a printing process.

Figure 5:
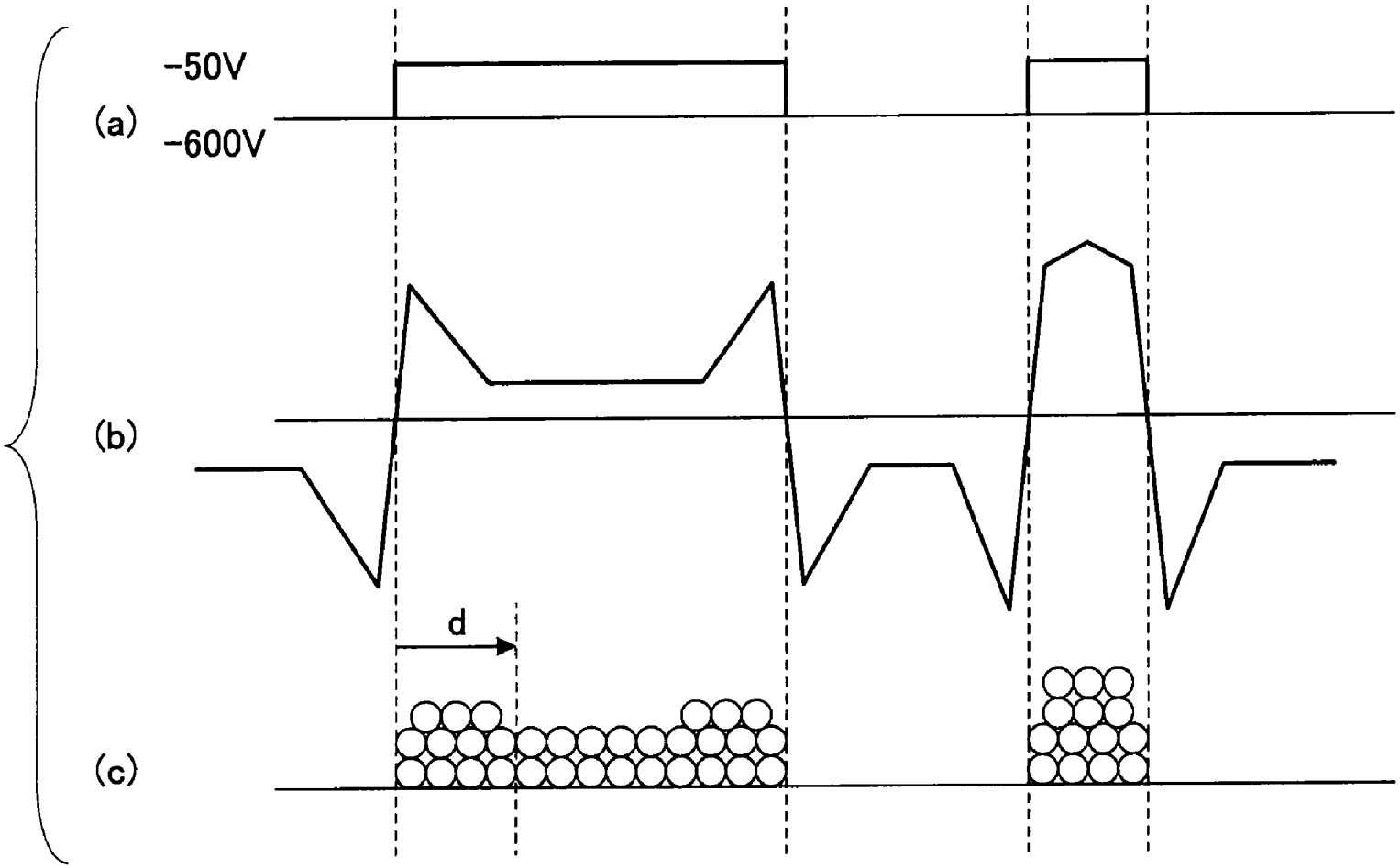
FIG. 5 shows a diagram illustrating the edge effect.

With reference to FIG. 5, the edge effect is described.

FIG. 5(*a*) shows a diagram of electrostatic latent images formed on the photosensitive member 202. The horizontal axis shows the position along the direction in which the latent image is developed on the photosensitive member 202, which is from the left to the right on the sheet of the drawing. The electrostatic latent image on the left corresponds to a square solid patch of one inch squares. The electrostatic latent image on the right corresponds to a lateral line patch with a line width 0.3 mm. The vertical axis in the drawing shows the surface potential of the photosensitive member 202. As shown, the surface potential, when converted into voltages at the developing position, is −50V at the image (exposed) portions and −600V at the non-image (non-exposed) portions.

FIG. 5(*b*) shows the developing electric field intensity over the photosensitive member in the developing area. The developing area includes a space between the photosensitive member 202 and the developing roll 208 in FIG. 2, where a developing gap may be set between 0.5 and 1.0 mm in an embodiment of the present invention. The developing electric field intensity on the photosensitive member indicates an electric field component in a direction from the photosensitive member 202 to the developing roll 208.

The negatively charged toner is caused to travel from the developing roll 208 and attach to the latent image portion on the photosensitive member 202 by an electric field formed in the developing area. In the case of the solid patch of one inch squares shown in the left-hand side of FIG. 5(*a*), the electric field intensity at the image edge portions at the front and rear sides (which are on the left and right sides of the sheet) is intensified by the concentration of electric flux lines. In the case of the lateral line patch on the right-hand side of FIG. 5(*a*) with the line width 0.3 mm, the edge effect from the front and rear edges (at the left and right sides on the sheet) are combined to produce an even stronger developing electric field.

FIG. 5(*c*) shows the attached toner amounts on the photosensitive member 202. At the image edge portions, the developing electric field is stronger, resulting in greater attached toner amounts. In the case of the 1-inch squares solid patch on the left in FIG. 5(*a*), the attached toner amount is greater in a region from the image edge to a distance d; the distance d may vary depending on conditions. In an embodiment, d may be 0.3 mm, where the attached toner amount in the region with distance d (which is defined as an edge portion) is about 1.2 to 1.5 times greater than an average attached toner amount in the image.

In the case of the lateral line patch with the line width of about 0.3 mm shown on the right in FIG. 5(*a*), both the left and right sides of the sheet produce the edge effect having the 0.3 mm range, resulting in an even greater amount of attached toner.

The edge effect becomes more pronounced as the gap in the developing area increases. Particularly in high-speed electrophotography apparatuses, the width of the recording medium to be recorded is large, and the distance (developing gap) between the developing roll and the photosensitive member is large. As a result, there is a strong edge effect and the image edges become denser, resulting in an outline and thus degrading image quality or, in a worse case, transfer error or defective fusing may occur at the edges.

The attached toner amount after development does not correspond to the aforementioned developing electric field intensity because of the developing process. For example, when the developing roll 208 and the photosensitive member 202 have the same circumferential rotating direction and the developing roll 208 has a higher circumferential speed, the attached toner amount at the front image edge portion (i.e., on the left side the sheet) becomes greater than the attached toner amount at the rear image edge portion (i.e., on the right side of the sheet). In some case, the edge effect may not appear at all at the rear edge portion of the image.

Figure 6:
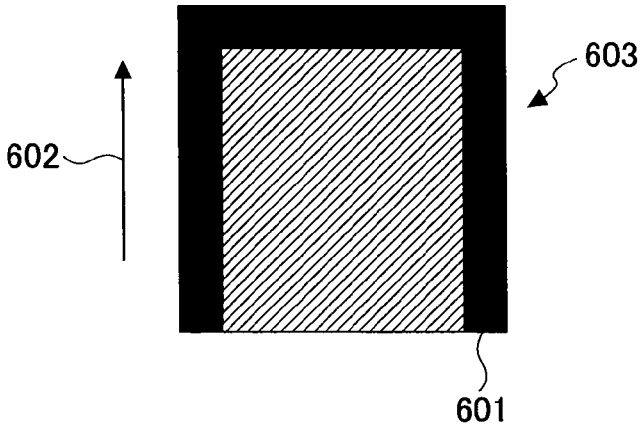
FIG. 6 shows a toner image of a solid patch formed on an intermediate transfer member by a conventional electrophotography apparatus.

FIG. 6 shows a toner image on the intermediate transfer member 101 corresponding to a solid patch 603 formed by a conventional electrophotography apparatus. It was observed that the attached toner amount was 1.2 to 1.5 times the average attached toner amount within the solid patch in the bands of regions (toner patch periphery portion 601) at the front-end (above in the drawing sheet) and the sides (horizontally in the sheet) with respect to a recording medium transported direction 602, the bands having a width of about 0.25 to 0.35 mm from the edges.

In the present specification, an attached toner amount ratio is defined as the ratio of the attached toner amount in the toner patch periphery portion to the average attached toner amount in the patch. At the rear edge (bottom of FIG. 6) of the toner image, a certain phenomenon which may be referred to as "rear-edge loss" occurs separately from the edge effect, whereby the edge effect is cancelled. Thus, the intensity of the edge effect may differ between the front-end edge portion and the rear-end edge portion along the recording medium transported direction, or between the right-side edge portion and the left-side edge portion.

Figure 7:
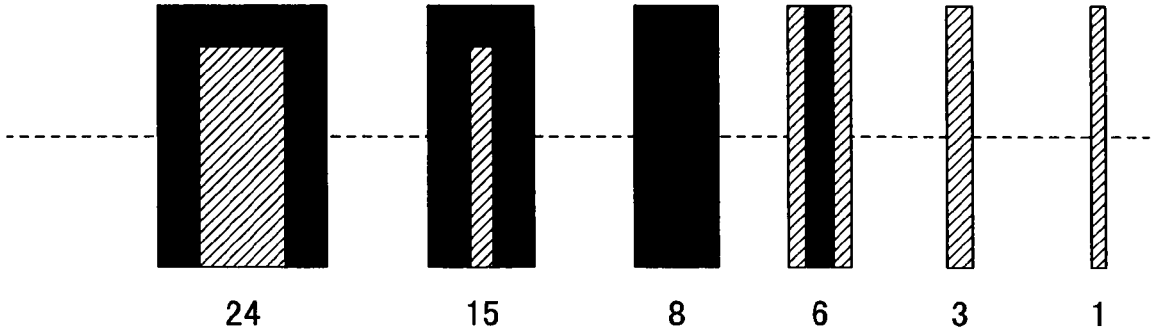
FIG. 7 shows toner images of thin-line patches formed on an intermediate transfer member by a conventional electrophotography apparatus.

FIG. 7 shows toner images of various thin-line patterns formed on the intermediate transfer member 101 by the conventional electrophotography apparatus. The numbers below the toner images indicate the line widths in terms of the number of dots of 600 dpi.

Referring to the 24-dot width line (1.02 mm) at the left, the attached toner amount is greater in the peripheral regions with the width of about 0.3 mm, as in the solid patch 603. As the line width becomes smaller toward the right, the interval between the edge effect regions just keeps decreasing until the 14-dot width line (0.59 mm). Beyond that, the edge effects in the left and right regions are combined, causing an even higher peak attached toner amount. The peak attached toner amount becomes maximum at about the 8-dot width (0.34 mm), where the attached toner amount ratio is as much as 1.6 to 1.7.

As the line becomes even narrower than the 8-dot width line (0.34 mm), the attached toner amount sharply decreases, with the 3-dot width line (0.127 mm) and below having an attached toner amount ratio of less than one. The single-dot width line (0.042 mm) has an attached toner amount ratio of 0.7. In fact, such a narrow line width region is also subjected to the edge effect; however, the resolution of the electrophotography apparatus used is lacking so much that the obtained toner amount becomes less than a target attached amount. In other words, the resolution of the thin line in such regions is maintained by the edge effect. If the edge effect is not present, single-dot images or thin lines may not be accurately recorded.

Figure 8:
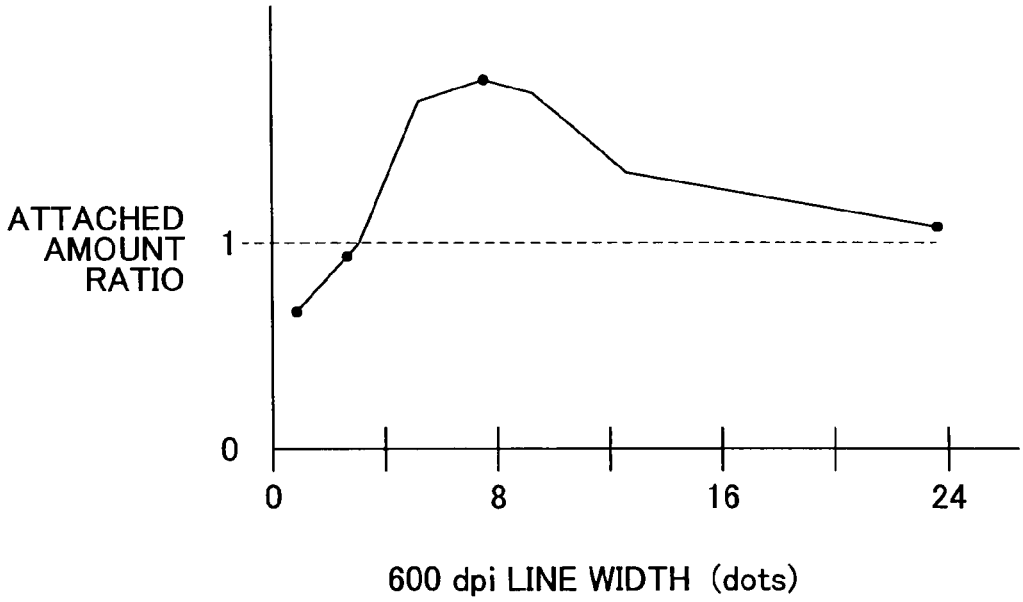
FIG. 8 shows a graph illustrating a relationship between the line width of a vertical-line patch and the attached toner amount ratio.

FIG. 8 shows a chart illustrating the relationship between the line width and the attached toner amount ratio of the vertical-line patches. The horizontal axis shows the line width of the vertical-line patches in the number of dots of 600 dpi. The vertical axis shows the attached toner amount ratio.

As is seen from the chart, the attached toner amount ratio has a peak at the line width of about 8 dots, i.e., around 0.33 mm. For the thinner lines with the line widths of less than 3 dots, the attached toner amount ratio becomes less than one. Analyses conducted by the present inventors have shown that the peak position and the peak value vary by about 10 to 20% due to environment or aging and variations among individual apparatuses.

In the related art according to Patent Documents 3 and 4, the aforementioned characteristics are not taken into consideration. As a result, the related art corrects the attached toner amount to be less than an appropriate value for single-dot images or single-dot-width lines, thus resulting in the problems of blurring or absence of the image.

In accordance with an embodiment of the present invention, the edge effect can be controlled without causing such blurring or absence of a single-dot image or single-dot-width line.

Figure 3:
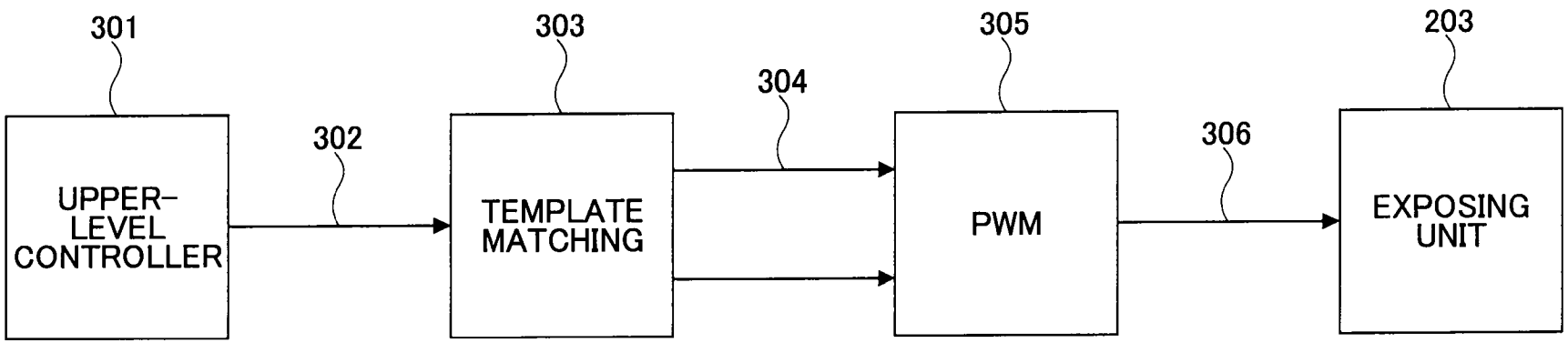
FIG. 3 shows a block diagram illustrating the flow of a signal processing from an upper-level controller to the exposing unit of the electrophotography apparatus.

FIG. 3 shows a flow of signal processing from an upper-level controller 301 to the exposing unit 203 according to an embodiment of the present invention. The upper-level controller 301 outputs monochrome binary (1 bit) original image data 302 corresponding to the pixels with resolution of 600 dpi. It is assumed herein that, even when the original image consists of image data having a gradation, the data is converted into binary form by the upper-level controller 301 using a known binarizing technology, such as the dither method or the error diffusion method. The same concept for the monochrome binary data can be also applied to color data as long as the data is binarized for each color.

The binary original image data 302 is then supplied to a conventional template matching circuit 303 to determine whether it contains image edge pixels as well as the normal monochrome pixels. As a result, 2-bit (0, 1, 2, 3) determined image data 304 is obtained, where "0" indicates an image white portion, "2" indicates an image edge portion, and "3" indicates an image black portion, with "1" unused.

The 2-bit (three-values) determined image data 304 is then supplied to a conventional pulse width modulation (PWM) circuit 305, whereby pixel data 306 is generated by pulse-width modulating the data in such a manner as to correspond to the turning on and off of the exposing unit 203.

Specifically, when the determined image data 304 is "0", the pixel data 306 indicates 0% (no emission of light); when "2", the pixel data 306 indicates an edge control ratio (ECR) (%); and when "3" the pixel data 306 indicates 100% (pixel emits light at all times). The ECR can be changed by varying the pulse width that is outputted by the pulse width modulation (PWM) circuit 305 when the determined image data 304 indicates "2". It is assumed herein that the ECR is initially set at 75%. The ECR is varied as needed based on testing image patches, as will be described later.

The pixel data 306 is guided to the exposing unit 203, which controls the turning on and off of a light source in accordance with the pixel data 306. The above signal processing is carried out in real time with respect to the emission of the light source.

Figure 4:
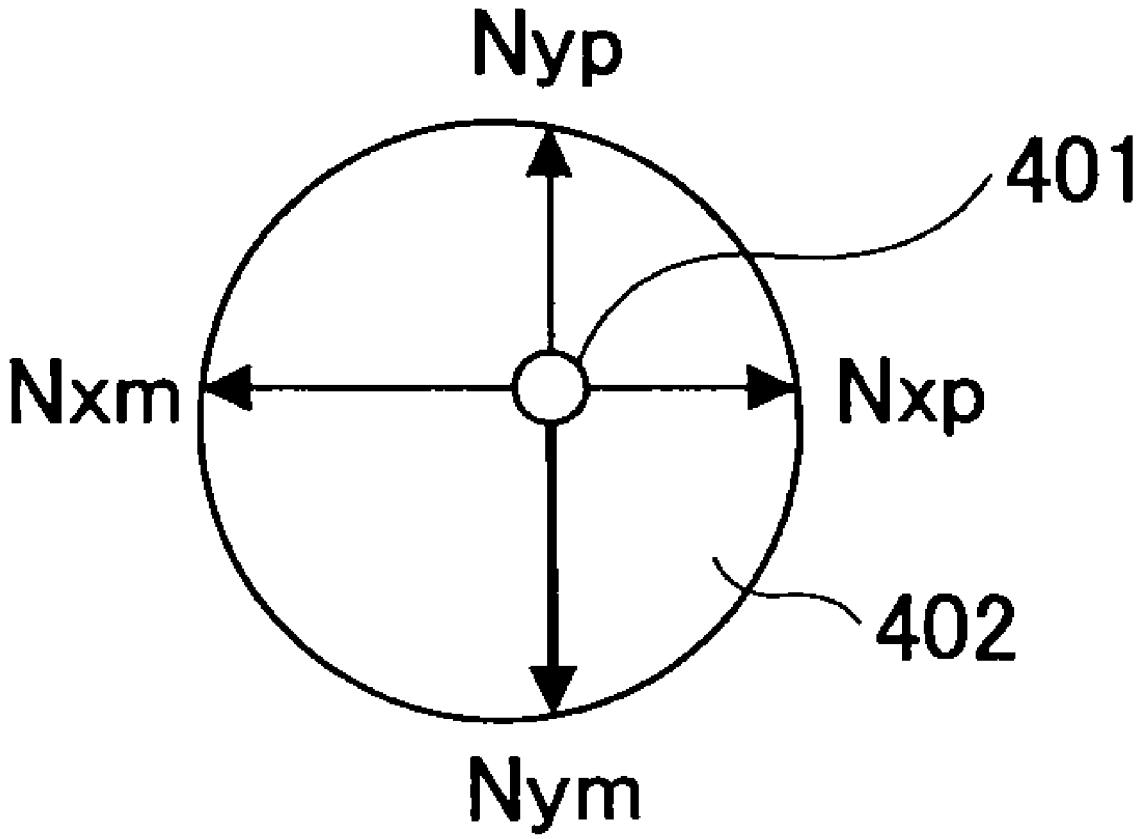
FIG. 4 shows a template used in a template matching circuit.

FIG. 4 shows a template 402 used in the template matching circuit 303. In the electrophotography apparatus according to the present embodiment, the template 402 includes two types; namely, template A with a smaller size, and template B with a larger size. Each template 402 has a substantially circular region, at about the center of which there is a reference pixel position 401. More accurately, as shown in FIG. 4, the numbers of pixels from the reference pixel position 401 to the edges of the template region are Nxp, Nxm, Nyp, and Nym.

In the present embodiment, when the smaller template A is defined by (Nxpa, Nxma, Nypa, Nyma) and the larger template B is defined as (Nxpb, Nxmb, Nypb, Nymb), the following inequality expressions hold:

$$Nxpa \leqq Nxpb,$$

$$Nxma \leqq Nxmb,$$

$$Nypa \leqq Nypb, \text{ and}$$

$$Nyma \leqq Nymb.$$

The individual pixels of the template 402 are not shown in the drawing because the pixels and their values (either 0 or 1) are very small. In the present embodiment, the values of the pixels, including at the reference pixel position 401, are all 1.

Once the reference pixel position 401 that is recorded after the input original image data 302 (see FIG. 3) is determined, the original image data 302 and the template 402 are compared on a pixel by pixel basis. In the present embodiment, because the values of the pixels of the template 402 are all one, the original image data 302 is determined to match the template 402 if the values of the original image data 302 at the corresponding template positions are all one. Such determination is performed for all of the original image data 302 while the reference pixel position 401 is shifted one pixel at a time in the order of recording.

Figure 9:
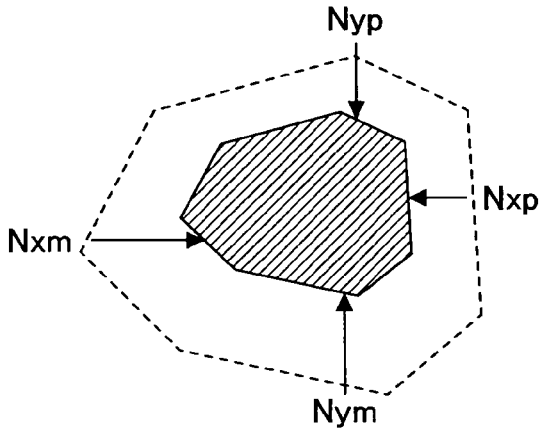
FIG. 9 shows a pixel area that is determined to match original image data by a method using a template.

FIG. 9 shows a pixel area that has been determined to match the template 402. The region within the broken lines corresponds to the black ("1") portion of the original image data 302, and the areas outside the region correspond to the white ("0") portions. A region further within that is hatched is the pixel region that has been determined to match the template 402. This hatched region is smaller than the black portion of the original image data 302 by Nxp and Nxm horizontally and Nym and Nyp vertically. Such template processing is known as skeletonizing, whereby a figure is reduced in size.

Figure 10A:
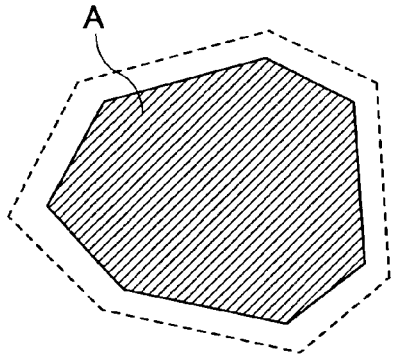
FIG. 10A shows an image region extracted using a template A.
Figure 10B:
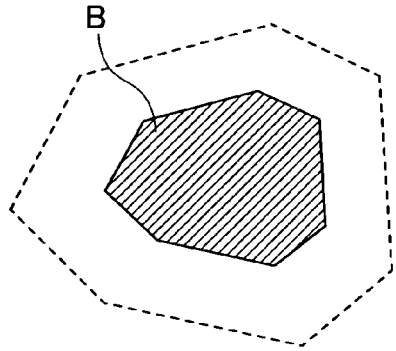
FIG. 10B shows an image region extracted using a template B.
Figure 10C:
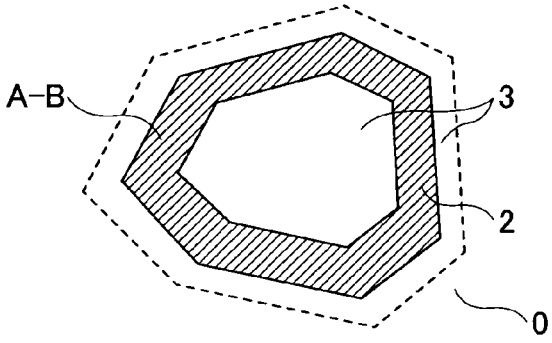
FIG. 10C shows an image region obtained by subtracting the image region of FIG. 10B from the image region of FIG. 10A.

FIGS. 10A to 10C show image regions extracted by the template matching circuit 303 according to the present embodiment. The following description is based on the assumption that the size of the smaller template A (Nxpa, Nxma, Nypa, Nyma) is such that Nxpa=Nxma=Nypa=Nyma=2, and the size of the larger template B (Nxpb, Nxmb, Nypb, Nymb) is such that Nxpb=Nxmb=Nypb=6 and Nymb=4. A specific method for determining these values is described later.

FIG. 10A shows an image region A that is determined to match the template A. FIG. 10B shows an image region B that is determined to match the template B. Because the template A is smaller, the extracted image region A is larger than the image region B of the template B. FIG. 10C shows an image region A-B in which the image region B is subtracted from the image region A. As shown, the region A-B is a band of region spaced apart from the image edge by a predetermined distance. The band region is hereafter referred to as a "specific edge region".

The output of the template matching circuit 303 is defined as follows:

(1) When the data of the original image data 302 at the reference pixel position 401 is "0" (white dot), the determined image data 304 (see FIG. 3) is "0".

(2) When the data of the original image data 302 at the reference pixel position 401 is "1" (black dot) and is determined to be matching by the determination in the template matching circuit 303, the determined image data 304 is "2".

(3) When the data of the original image data 302 at the reference pixel position 401 is "1" (black dot) and is determined not to be matching by the template matching circuit 303, the determined image data 304 is "3".

In accordance with the present embodiment, the specific edge region includes band regions that extend from the upper and horizontal edges along the periphery of the image toward the center of the image, between the third dot and the sixth dot (i.e., 84 to 252 μm when 600 dpi), and a band region from the lower edge along the image periphery toward the center between the third dot and the fourth dot (84 to 168 μm when 600 dpi).

These band regions match the aforementioned region in which the edge effect is present. Thus, by reducing the amount of exposure to the specific edge region compared to the other portions, the attached toner amount in the specific edge region can be controlled to an appropriate value.

In FIGS. 9 and 10A through 10C, the recording medium transport direction (y direction) is in the vertical direction on the sheet of the drawings. In terms of line width, no image edge portion appears in vertical lines (along the y axis) having the 4-dot line width (168 μm in the case of 600 dpi) and smaller. In the case of lines with 5 to 12 dot line widths (210 to 504 μm in the case of 600 dpi), the central portion becomes the image edge portion. When the line width is 13 dots or more, the central portion ceases to be the image edge portion. In other words, in the case of vertical lines, up to 12 (=6+6) dots are corrected because the template B has Nxpb=6 and Nxmb=6, but a non-corrected portion appears in the central portion above 13 dots or more.

Similarly, with regard to lateral lines (along the x axis), no image edge portion appears in lines with the line width of 4 dots (which is 168 μm in the case of 600 dpi) or less. In the case of lines with the line width of 5 to 10 dots (210 to 420 μm when 600 dpi), the central portion becomes the image edge portion. When the line width is 11 dots or more, the central portion ceases to be the image edge portion. In other words, in the case of lateral lines, up to 10 (=6+4) dots are corrected because the template B has Nypb=6 and Nymb=4, and a non-corrected portion appears in the central portion for 11 dots and above.

In the case of the above larger and smaller templates, lines thinner than the 4-dot line width are not subject to the exposure amount adjustment for preventing the edge effect because such lines do not contain an image edge portion. Normally, the resolution of a printing system gradually deteriorates near the limit resolution of the system. Similarly, in the electrophotography apparatus according to the present embodiment, resolution is degraded at around 600 dpi. Therefore, in the case of lines with the line width of 168 μm or less, improved resolution can be obtained by taking advantage of the edge effect rather than eliminating it.

In terms of halftone dot image, because the number of lines per inch (lpi) in a halftone dot image is normally greater than 141 lpi, halftone dots are formed every three dots at most vertically and horizontally in the case of the screen angle of 45° and 600 dpi. On the other hand, in the electrophotography apparatus according to the present embodiment of the present invention, lines thinner than 4-dot line width are not corrected as mentioned above, so that no correction is performed inside a halftone dot image. Thus, the halftone reproducibility of a halftone dot image formed in a highly accurate gradation process by the upper-level controller is not adversely affected by the present embodiment. Of course, the central portion of a solid portion having a certain size within a halftone dot image is subject to the processing according to the present embodiment. However, the edge portion of the halftone dot image is not. Correction of the edge portion of the halftone dot image, if it is necessary, may be carried out in a gradation process by the upper-level controller.

Referring back to FIG. 3, the pulse width modulation (PWM) circuit 305 is described. In the present embodiment, the amount of exposure to a pixel in the edge portion is reduced by performing a fine pulse width modulation within the pixel.

The determined image data 304 is defined so that it is "0" when the original image data 302 is "0" (white); "2" when the original image data 302 is "1" (black) and forms an image edge portion; and "3" when the original image data 302 is "1" (black) and forms a portion other than an image edge portion (see FIG. 10C).

The image data 306 outputted by the PWM circuit 305 is pulse-wave modulated at 0% when the original image data 302 is "0" (white); a percentage determined by the ECR (%) when the original image data 302 is "1" (black) and forms an image edge portion; and 100% when the original image data 302 is "1" (black) and forms a portion other than an image edge portion.

The image data 306 is converted into a light-emitting output by the exposing unit 203, which may include a semiconductor laser and its drive circuit, and the photosensitive member 202 is exposed by the emitted light.

Because the pulse width modulation is carried out within the dot, the pulse widths are sufficiently smaller than the exposure spot diameter of laser. The pulses of light are therefore integrated so that, in terms of the exposure amount on the photosensitive member 202, this has substantially the same effect as reducing the amount of exposure given to the dot in an analog manner.

For example, when the ECR=75%, the exposure amount to an image edge portion can be reduced by 25% compared with other portions, so that the attached toner amount in the image edge portion can be controlled to an appropriate value.

Regarding the value of the ECR, i.e., the ratio of the amount of exposure to the edge effect region, an increment in attached amount due to the edge effect may be precisely measured in advance. However, the edge effect fluctuates depending on changes in development characteristics due to environment. It also increases as the film thickness of the photosensitive member decreases over time, and its intensity varies depending on the instrumental error in the developing gap. Thus, if the ECR is held at a constant value, a strong correction may be implemented where the edge effect is weakened, whereby the attached toner amount may be conversely lacking in the edge portion. Thus, it is necessary to measure the intensity of the edge effect at regular time intervals for each apparatus.

In the following, a description is given of a method for measuring the influence of the edge effect on the attached toner amount so that the values of the ECR and sizes of the templates A (Nxpa, Nxma, Nypa, Nyma) and B (Nxpb, Nxmb, Nypb, Nymb) that are optimized can be determined.

Figure 11:
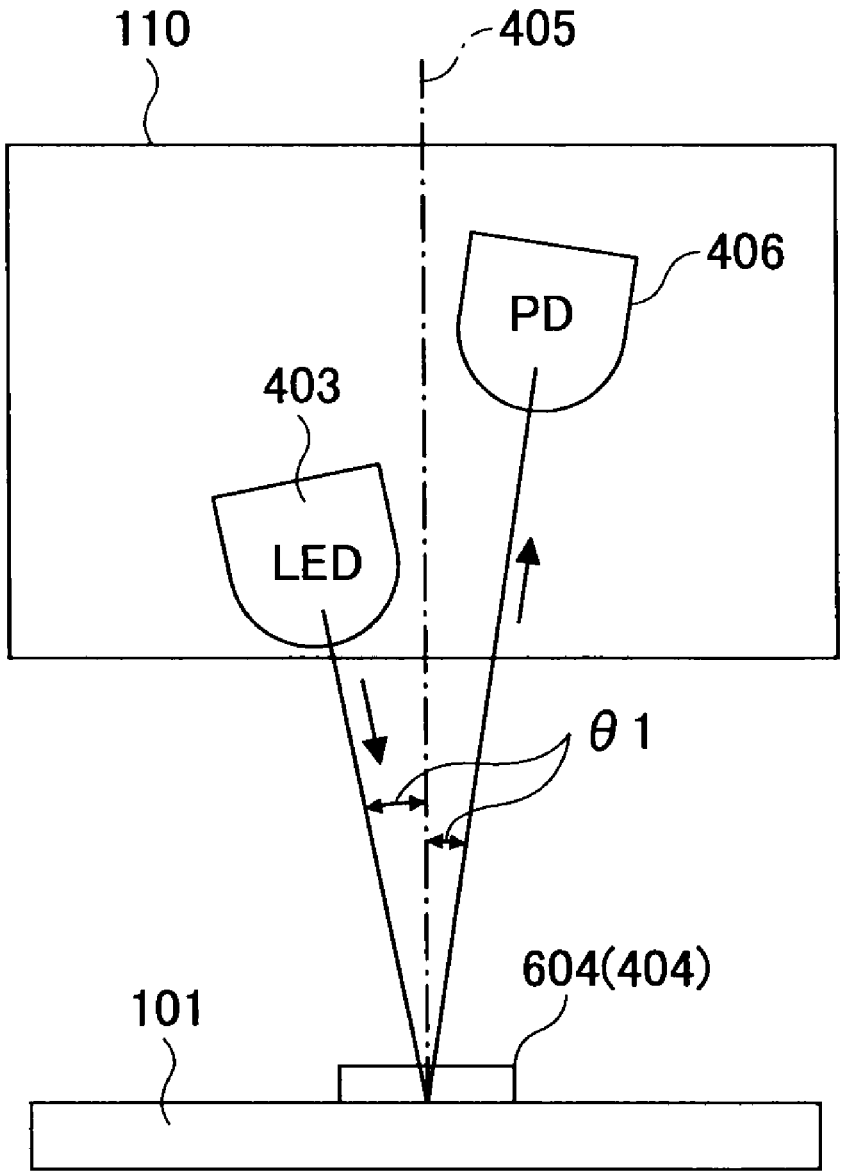
FIG. 11 shows a structure of an optical sensor and a measurement region.

FIG. 11 shows a typical configuration of the optical sensor 110 and a measured region.

The light emitted by an infrared light source LED 403 is collected by slits and lenses (not shown) on an intermediate transfer member 101 or a measurement region 404 of a testing patch 604 placed thereon. The measurement region 404 is disposed opposite to the optical sensor 110 so that a sensor center axis 405 is normal to the measurement region 404.

The angle of incidence from the LED 403 is θ1. The angle at which the light is reflected with the same angle θ1 is called the specular reflection angle, and specular reflection light is reflected only in the direction of the specular reflection angle. A photodiode (PD) 406 is disposed in the direction of incidence of the specular reflection light so that it can receive the specular reflection light via a slit or lenses (not shown). The PD 406 then outputs a specular reflection output voltage Vreg.

The size of the measurement region 404 of the PD 406 can be adjusted by the slit or lenses. In an embodiment, the measurement region 404 may have the same width of 0.3 mm of the edge region where the edge effect is produced, so that the intensity of the edge effect can be accurately measured.

Figure 12:
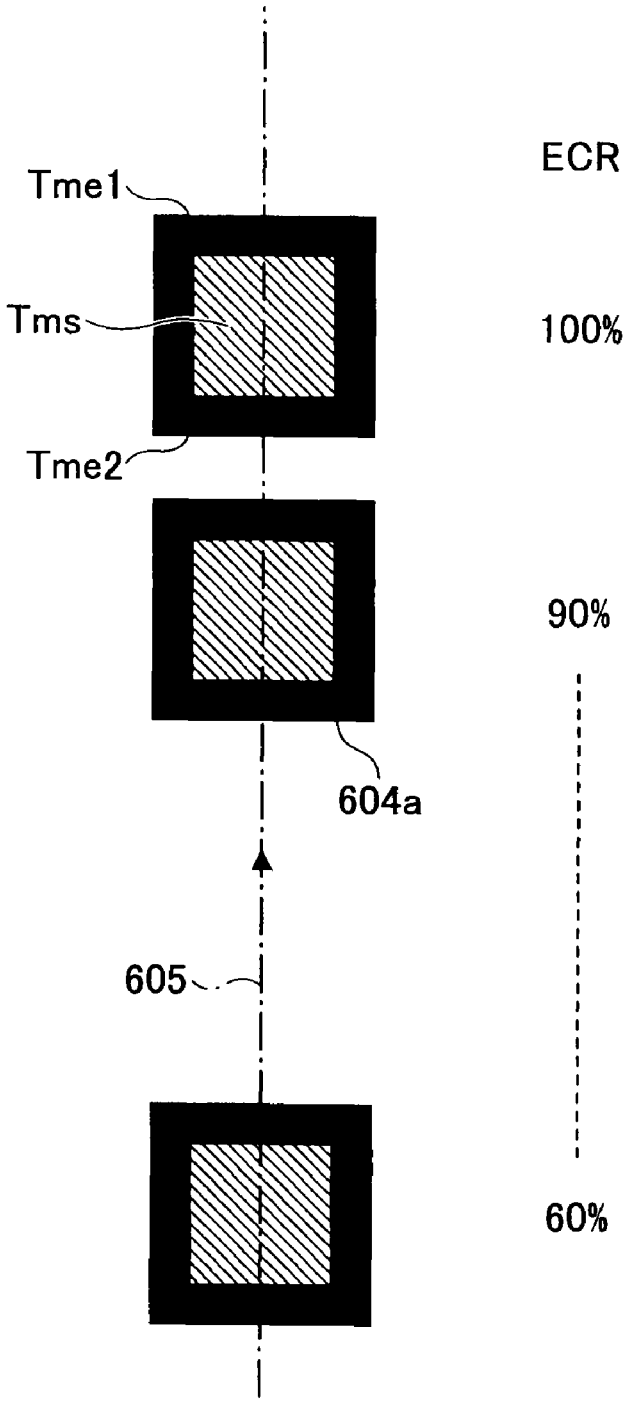
FIG. 12 shows a series of rectangular testing patches according to an embodiment of the invention.

With reference to FIGS. 12 and 13, a method of forming the testing patch 604 on the intermediate transfer member 101 is described. FIG. 12 shows a testing patch 604*a* of the solid type.

The arrows 605 in the figures indicate the direction of movement of the intermediate transfer member 101, which is from the bottom to the top of the drawing sheets. Because the optical sensor 110 is fixed, it measures the toner attached amount relatively from the top to the bottom over the dotted line.

The initial testing patch 604*a* is exposed at the ECR of 100%, i.e., 100% PWM, at the specific edge region. The initial testing patch 604*a* is then read by the optical sensor 110, whereby attached toner amounts Tme1, Tms, and Tme2 for the front-end (top of the sheet) edge portion, the image central portion, and the rear-end (bottom of the sheet) edge portion, respectively, are read. The values of Tme1 and Tme2 are greater than that of Tms. Based on this information, if any of the values of Nypa, Nyma, Nypb, and Nymb regarding the front-end and the rear-end in the sizes (Nxpa, Nxma, Nypa, Nyma) and (Nxpb, Nxmb, Nypb, Nymb) of the current templates A and B is inappropriate, it is corrected.

Then, the specific edge region is exposed at 90% (i.e., ECR=90%). This is followed by measuring the attached toner amounts Tme1 and Tme2 at the front-end (top of the sheet) edge portion and the rear-end (bottom of the sheet) edge portion with the optical sensor 110.

In this way, five of the testing patches 604*a* of the solid type are formed by varying the ECR value for the edge portion at 10% intervals from 100% to 90%, 80%, . . . to 60%. Thereafter, the attached toner amounts Tme1 and Tme2 for the both edge portions of each of the testing patches are measured. The shape of the testing patch 604*a* may be square or rectangular.

In a method for determining the ECR, a value of the ECR that minimizes the difference between Tme1 and Tme2 and Tms may be employed. It is now supposed that the edge effect is minimized when the ECR=80%, i.e., when the edge portion is exposed with 80% PWM. If the difference between Tme1 and Tme2 and Tms does not become smaller than a predetermined amount in any of the patches, the values of Nypa, Nyma, Nypb, and Nymb that concern Tme1 and Tme2 among the sizes (Nxpa, Nxma, Nypa, Nyma) and (Nxpb, Nxmb, Nypb, Nymb) of the templates A and B are corrected.

Figure 13B:
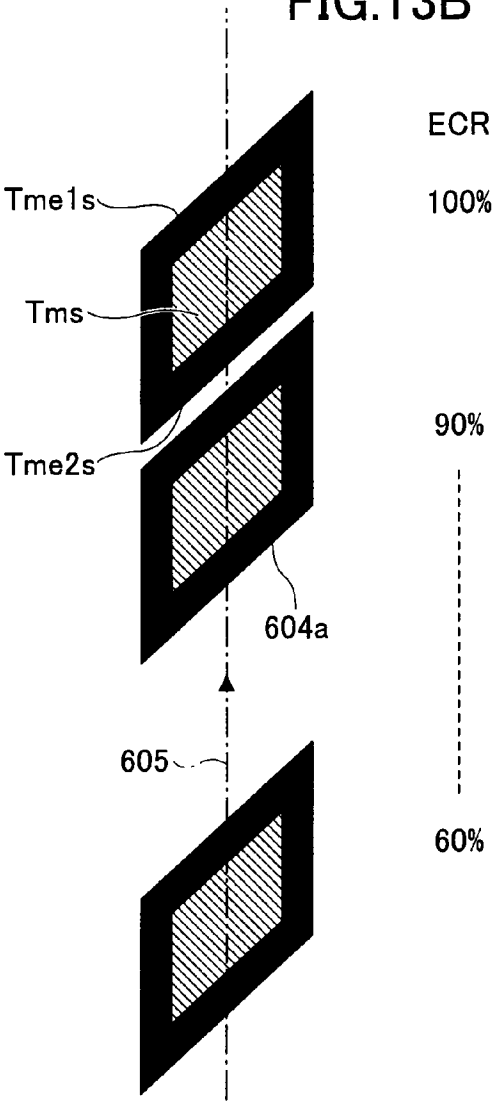
FIGS. 13A and 13B show parallelogram testing patches according to another embodiment of the present invention.
Figure 13A:
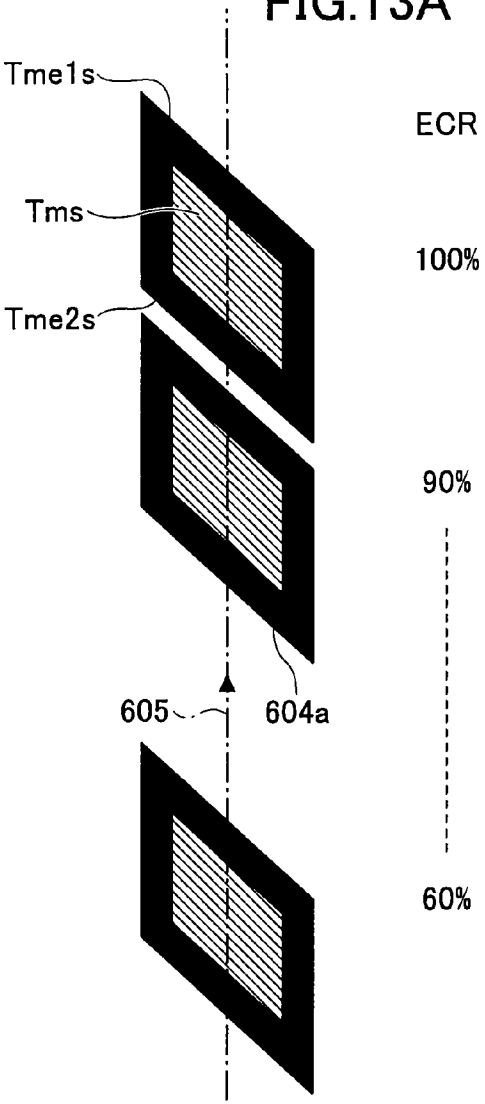

FIGS. 13A and 13B show another example of the solid-type testing patch 604*a*. In the case of FIG. 13A, both the front-end edge portion and the rear-end edge portion that are measured are inclined at 45° with their left sides located higher, with respect to the direction of movement 605 of the intermediate transfer member 101. By using such testing patches 604*a*, the influence of the edge effect from the right side can be included in the attached toner amount Tme1 measured at the top edge portion and in the position of the region with an increased attached toner amount. Also, the influence of the edge effect on the left side can be included in the attached toner amount Tme2 measured at the rear-end edge portion.

In the case of FIG. 13B, the front-end edge portion and the rear-end edge portion that are measured are both inclined at 45° with respect to the direction 605 of movement of the intermediate transfer member 101, with their right sides located higher. By using such testing patches 604*a*, the influence of the edge effect from the left end can be included in the attached toner amount Tme1 measured at the front-end edge portion and in the position of the region with the increased attached toner amount. Also, the influence of the edge effect from the right end can be included in the attached toner amount Tme2 measured at the rear-end edge portion.

In an embodiment, the series of rectangular testing patches shown in FIG. 12 may be formed on the intermediate transfer member 101, and thereafter the series of the parallelogram testing patches shown on either the left or the right in FIG. 13 may be formed. By reading the rectangular testing patches and the parallelogram testing patches, the influence of the edge effects on the left and right edges of the testing patches can be calculated based on the difference between the rectangular testing patches and the parallelogram testing patches.

Hereafter, a description is given of a method for determining the attached toner amount at the upper, lower, left, and right edge portions using the rectangular testing patches shown in FIG. 12 and the 45°-inclined parallelogram testing patches shown in FIG. 13.

First, the series of the rectangular testing patches shown in FIG. 12 is formed on the intermediate transfer member 101.

The attached toner amount Tme1 in the front-end edge portion and the attached toner amount Tme2 in the rear-end edge portion of each testing patch are measured. In the present embodiment, Tme1 and Tme2 indicate peak values of the attached toner amounts.

Then, the series of the 45°-inclined parallelogram testing patches shown in FIG. 13A are formed on the intermediate transfer member 101. The attached toner amount Tme1*s* in the front-end edge portion and the attached toner amount Tme2*s* in the rear-end edge portion of each of the testing patches are then measured.

Based on the measured results, an attached toner amount TmeR for the right edge portion and an attached toner amount TmeL for the left edge portion are calculated by the following equations:

$$TmeR=2\times Tme1s-Tme1 \quad (1)$$

$$TmeL=2\times Tme2s-Tme2 \quad (2)$$

Then, the parallelogram testing patches inclined at 45° shown in FIG. 13B are prepared and, as in FIG. 12, the attached toner amount Tme1*s* for the front edge portion and the attached toner amount Tme2*s* for the rear edge portion of each of the testing patches are determined.

Based on the obtained results, the attached toner amount TmeR for the right edge and the attached toner amount TmeL for the left edge are calculated by the following equations:

$$TmeL=2\times Tme1s-Tme1 \quad (3)$$

$$TmeR=2\times Tme2s-Tme2 \quad (4)$$

Finally, the results of FIGS. 13A and 13B are averaged to determine an attached toner amount for each of the left and right edges.

In another embodiment, the attached toner amounts on the left and right sides may be determined experimentally.

The above method may also be used for the region with an increased attached toner amount due to the edge effect on the left and right sides. Thus, based on the obtained results, if any of the values Nxpa, Nxma, Nxpb, and Nxmb concerning the left and right edges in the sizes (Nxpa, Nxma, Nypa, Nyma) and (Nxpb, Nxmb, Nypb, Nymb) of the current templates A and B is inappropriate, it is corrected.

Similarly, a method for determining the image edge width is described.

Figure 15A:
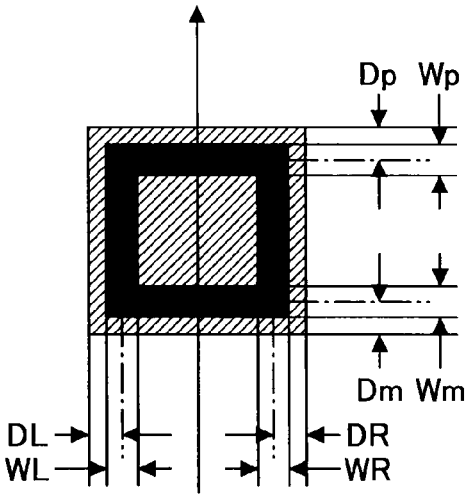
FIGS. 15A and 15B show drawings for defining the various distances and widths of the patches.

First, the series of rectangular testing patches shown in FIG. 12 are formed on the intermediate transfer member 101. In each of the testing patches, the following values are calculated: a distance Dp between the edge of the front edge portion and the center of a region with an increased attached toner amount due to the edge effect; a width Wp of that region in the y direction (recording medium transported direction); a distance Dm between the edge of the rear edge portion and the center of the region with the increased attached toner amount due to the edge effect; and a width Wm of that region in the y direction (recording medium transported direction). FIG. 15A shows a detailed drawing of the rectangular testing patch shown in FIG. 12.

Figure 15B:
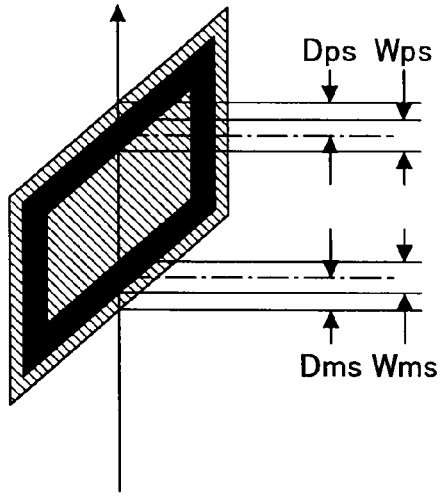

Thereafter, the series of parallelogram testing patches inclined at 45° shown in FIG. 13A are formed on the intermediate transfer member 101. Then, the following values are calculated for each of the testing patches: a distance Dps between the edge of the front edge portion and the center of a region with an increased attached toner amount due to the edge effect; a width Wps of that region in the y direction (recording medium transported direction); a distance Dms between the edge of the rear edge portion and the center of the region with the increased attached toner amount due to the edge effect; and a width Wms of that region in the y direction (recording medium transported direction). FIG. 15B shows a detailed drawing of the parallelogram testing patch inclined at 45° shown in FIG. 13.

Based on the obtained results, a distance DR between the right edge of the right edge portion and the center of the region with the increased attached toner amount due to the edge effect; a width WR of that region in the y direction (recording medium transported direction); a distance DL between the left edge of the left edge portion and the center of the region with the increased attached toner amount due to the edge effect; and a width WL of that region in the y direction (recording medium transported direction) are calculated by the following equations:

$$DR=2\times Dps-Dp \quad (5)$$

$$WR=2\times Wps-Wp \quad (6)$$

$$DL=2\times Dms-Dm \quad (7)$$

$$WL=2\times Wms-Wm \quad (8)$$

Thereafter, the series of the 45°-inclined parallelogram testing patches shown in FIG. 13B are formed, and then the following values for each of the testing patches are determined: a distance Dps between the edge of the front edge portion and the center of the region with the increased attached toner amount due to the edge effect; a width Wps of that region in the y direction (recording medium transported direction); a distance Dms between the edge of the rear edge portion and the center of the region with the increased attached toner amount due to the edge effect; and a width Wms of that region in the y direction (recording medium transported direction).

Based on the obtained results, the distance DR between the right edge of the right edge portion and the center of the region with the increased attached toner amount due to the edge effect; a width WR of that region in the y direction (recording medium transported direction); a distance DL between the left edge of the left edge portion and the center of the region with the increased attached toner amount due to the edge effect; and a width WL of the region in the y direction (recording medium transported direction) are calculated by the following equations:

$$DL=2\times Dps-Dp \quad (9)$$

$$WL=2\times Wps-Wp \quad (10)$$

$$DR=2\times Dps-Dm \quad (11)$$

$$WR=2\times Wps-Wm \quad (12)$$

FIGS. 15A and 15B define the aforementioned DL, WL, DR, WR, Dp, Wp, Dm, Wm, Dps, Wps, Dms, and Wms.

Thus, by using the testing patches 604*a* inclined with respect to the direction 605 of movement of the intermediate transfer member 101, the edge effects on the left and right edges can be measured. Thus, the ECR and the size of the templates A (Nxpa, Nxma, Nypa, Nyma) and B (Nxpb, Nxmb, Nypb, Nymb) can be determined by taking into consideration the intensity of the edge effects at all of the edge positions.

In the example shown in FIG. 13, the testing patches 604*a* are inclined at 45° with respect to the direction of movement 605 of the intermediate transfer member 101. This is merely an example and the testing patches 604*a* may be inclined at other angles. When the angle is other than 45°, however, the above calculation expressions need to be modified because the ratios of influence of the front, rear, left, and right edges on the inclined edges of the patch will be different.

In accordance with the present embodiment, the testing patches shown in FIGS. 12 and 13 are used in order to calculate the ECR ratio based on the attached toner amounts at the edge portions of the testing patches. Also, the size of the edge region is detected, and the sizes of the two kinds of templates with different sizes described with reference to FIGS. 4, 9, and 10 are determined.

The image data to be printed is then subjected to template matching using the two kinds of templates, and the exposure to the difference between the templates is controlled by the ECR.

Figure 14:
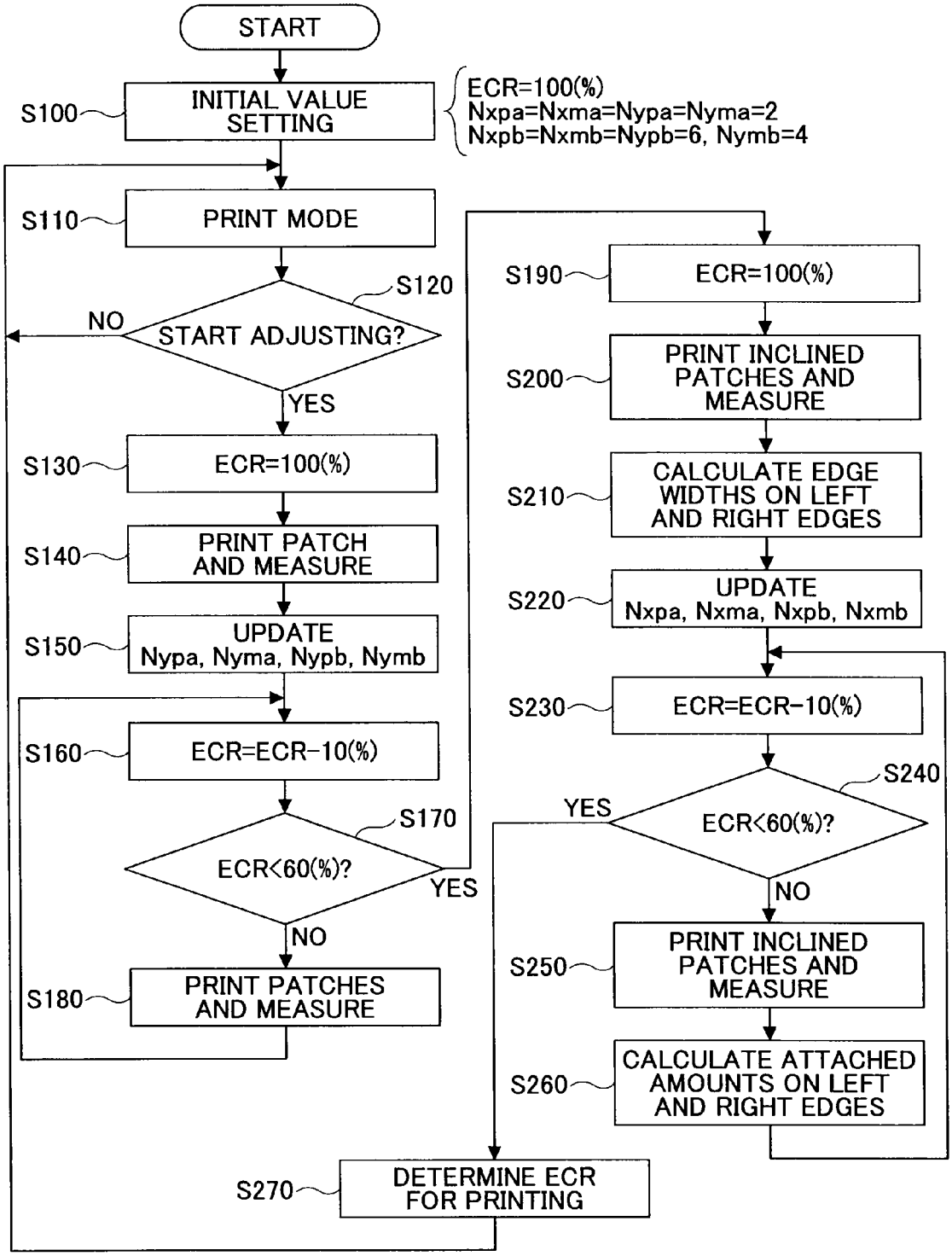
FIG. 14 shows a flowchart of a method for calculating and controlling an exposure amount for reducing the influence of the edge effect.

FIG. 14 shows a flowchart of the process of calculating and controlling the exposure amount for reducing the influence of the edge effect.

Step S100: Initial Value Setting

As initial values, the ECR and the sizes of the templates A and B are determined. Their values may be obtained by averaging, or the values determined for the previous control sequence may be substituted. In the present embodiment, the ECR=100% (no correction), and the sizes of templates A and B are the same as shown in FIG. 10, i.e., Nxpa=Nxma=Nypa=Nyma=2, Nxpb=Nxmb=Nypb=6, and Nymb=4.

Step S110: Print Mode

This is a mode in which the original image data 302 from the upper-level controller 301 is printed normally in the system shown in FIG. 3.

Step S120: Starting of Adjustment

This is where it is determined whether the mode should be switched to an adjustment mode for changing the ECR and the size of templates A and B to appropriate values. Normally, the determination is made after a print job based on a counted number of sheets of the recording medium that have been printed since the last adjustment. The switch to the adjustment mode may also take place when environment conditions have changed or after a component of the electrophotography apparatus has been replaced. Also, when the print job is very long, the adjustment mode may be compulsorily entered in the middle of the job.

Steps S130 and S140:

One of the testing patches shown in FIG. 12 is printed with the ECR=100%, and then the attached toner amounts in the front edge portion, the rear edge portion, and the patch intermediate portion are measured with the optical sensor 110. At the same time, the image edge widths at the front end and the rear end where more toner attaches than in the intermediate portion are detected.

Step S150: Updating of Nypa, Nyma, Nypb, and Nymb

Based on the image edge widths at the front and rear ends, the sizes of templates A and B in the front and rear end directions are determined so that they match the image edge widths.

Steps S160, S170, and S180:

Four of the testing patches shown in FIG. 12 are printed on the intermediate transfer member 101 while the ECR is reduced from 100% to 60% at 10% decrements. The attached toner amounts on the front-end edge portion and the rear-end edge portion of each patch are measured with the optical sensor 110, and the resultant data is stored in memory.

Steps S190 and S200:

The testing patches shown in FIGS. 13A and 13B are printed on the intermediate transfer member 101 one by one with the ECR=100%. The attached toner amounts in the front-end edge portion, the rear-end edge portion, and the patch intermediate portion on each patch are measured with the optical sensor 110. At the same time, the image edge widths at the front end and the rear end where more toner attaches than in the intermediate portion are detected. The testing patches may be the ones shown in either FIG. 13A or 13B.

Step S210:

Based on the image edge widths measured in S140 and S200, the image edge widths on the left and right sides are calculated by the aforementioned Equations (5) through (12).

Step S220:

Based on the image edge widths on the left and right sides calculated in step S210, the sizes of the templates A and B in the left and right directions are determined so that they match the image edge widths.

Steps S230, S240, and S250:

Four of the testing patches shown in FIGS. 13A and 13B are printed on the intermediate transfer member 101 while the ECR is reduced from 100% to 60% at 10% decrements. The attached toner amounts in the front-end edge portion, the rear-end edge portion, and the patch intermediate portion of each patch are measured with the optical sensor 110.

Step S260:

Based on the attached toner amounts in the front- and rear-end edge portions measured in S180 and S250, the attached toner amounts in the left and right side edge portions are calculated by the aforementioned equations (1) through (4) and stored in memory.

Step S270:

An ECR is determined by which the difference in the attached toner amounts is minimized between the front-end, rear-end, and left- and right-side image edge portions and the image intermediate portion that have been stored in memory with respect to the various stored edge control ratios ECR. If the difference cannot be reduced below a certain prescribed value, the sizes of the templates A and B are adjusted.

Thereafter, the routine returns to the print mode in step S110 and the normal printing process is started.

When the present invention is applied to a color electrophotography apparatus, the testing patches 604 are formed on the intermediate transfer member 101 for the individual colors.

Thus, the testing patches 604 are formed during the period in which the normal printing process of the electrophotography apparatus is not performed, and their attached toner amounts are measured using the optical sensor 110, whereby an appropriate ECR can be determined. Thereafter, the normal printing process is performed based on the determined ECR, so that a high quality output image having no edge effect can be obtained.

Although this invention has been described in detail with reference to certain embodiments, variations and modifications exist within the scope and spirit of the invention as described and defined in the following claims.

For example, while in the foregoing embodiments the testing patches are formed on the intermediate transfer member, the present invention is not limited to such embodiments. In another embodiment, the testing patches may be formed on another toner image carrier, such as a photosensitive member.

While the above embodiments of the present invention have been directed to a color electrophotography apparatus, the present invention is not limited to such embodiments and may be applied to a monochrome electrophotography apparatus.

The present application is based on the Japanese Priority Applications No. 2008-052269 filed Mar. 3, 2008, and No.

2008-236595 filed Sep. 16, 2008, the entire contents of which are hereby incorporated by reference.

What is claimed is:

1. An electrophotography apparatus comprising:

a template matching circuit configured to determine an image region in an image to be recorded based on original image data from an upper-level controller;

a pulse width modulation circuit configured to generate image data in which the image data is pulse-width modulated based on a result of the determination made in the template matching circuit;

an exposing unit configured to perform exposure based on the image data modulated by the pulse width modulation circuit;

a toner image carrier configured to carry a toner image based on an electrostatic latent image formed by the exposing unit;

a testing patch forming unit configured to form a toner image of a testing patch on the toner image carrier;

an attached toner amount measuring unit configured to measure an amount of toner attached in the testing patch toner image from a front edge to a rear edge thereof;

a testing patch edge detecting unit configured to detect an edge portion of the testing patch toner image where the attached toner amount is greater than in other portions of the testing patch toner image;

a template generating unit configured to generate, based on the edge portion detected by the testing patch edge detecting unit, two kinds of templates having different sizes by determining a number of pixels between a reference pixel position and each of upper, lower, left, and right edges;

an edge pixel region calculating unit configured to perform template matching on the image data to be printed using the templates, wherein a smaller region determined by the larger template is subtracted from a larger region determined by the smaller template to calculate a difference region as an edge pixel region of the image data; and an exposure amount setting unit configured to set an exposure amount for an electrostatic latent image portion corresponding to the edge pixel region, wherein the exposure amount for the edge pixel region of the original image data is controlled based on the exposure amount set by the exposure amount setting unit.

2. The electrophotography apparatus according to claim 1, wherein a plurality of testing patches are formed by the testing patch forming unit, wherein the testing patches are exposed with different exposure amounts, and wherein the exposure amount when the difference in attached toner amount between the front edge portion, the rear edge portion, and an intermediate portion of each of the testing patches is minimum is set in the exposure amount setting unit.

3. The electrophotography apparatus according to claim 1, wherein the testing patch formed on the toner image carrier includes a rectangular patch or a parallelogram patch that is inclined with respect to a direction of movement of the toner image carrier.

4. The electrophotography apparatus according to claim 1, wherein the testing patch edge detecting unit forms a rectangular patch having a front-end edge portion and a rear-end edge portion that are perpendicular to a direction of movement of the toner image carrier, successively measures an attached toner amount in the rectangular patch along the direction of movement of the toner image carrier, and calculates, based on the measured amounts of attached amounts of toner in the rectangular patch, a position of and an attached toner amount in the front-end edge portion and the rear-end edge portion of the rectangular patch where the attached toner amount is increased, wherein the testing patch edge detecting unit forms a parallelogram patch having a front-end edge portion and a rear-end edge portion that are inclined with respect to the direction of movement of the toner image carrier, successively measures an attached toner amount in the parallelogram patch along the direction of movement of the toner image carrier, and calculates, based on the measured amounts of attached toner in the parallelogram patch, a position of and an attached toner amount in the front-end edge portion and the rear-end edge portion of the parallelogram patch where the attached toner amount is increased, wherein the testing patch edge detecting unit further calculates a position of and an attached toner amount in a left-side edge portion and a right-side edge portion of the rectangular patch that are parallel to the direction of movement of the toner image carrier where the attached toner amount is increased, based on the positions and attached toner amounts measured for the rectangular patch and the parallelogram patch.

5. The electrophotography apparatus according to claim 4, wherein the template generating unit determines the positions of the front-end edge portion, the rear-end edge portion, the left edge portion, and the right edge portion of the testing patch where the attached toner amount is increased when the exposure amount has a predetermined value, the template generating unit determining a size of each of the two kinds of the templates having different sizes based on the determined positions, wherein the attached toner amounts at the front-end edge portion, the rear-end edge portion, the left edge portion, and the right edge portion of the testing patch are determined when the exposure amount is varied, wherein an exposure amount that minimizes a difference in attached toner amount between the front-end edge portion and the rear-end edge portion is determined based on the attached toner amounts that are measured when the exposure amount is varied, and the thus determined exposure amount is set in the exposure amount setting unit.

6. The electrophotography apparatus according to claim 1, wherein a distance between an outer contour of the edge pixel region calculated by the edge pixel region calculating unit and a contour of an image portion outside the edge pixel region is greater than a halftone dot interval of a halftone dot image.

7. The electrophotography apparatus according to claim 6, wherein the distance between an outer contour of the edge pixel region calculated by the edge pixel region calculating unit and a contour of an image portion outside the edge pixel region is 4/600 inch or greater.

* * * * *

UNITED STATES PATENT AND TRADEMARK OFFICE

CERTIFICATE OF CORRECTION

PATENT NO. : 7,974,544 B2
APPLICATION NO. : 12/395829
DATED : July 5, 2011
INVENTOR(S) : Shinya Kobayashi et al.

It is certified that error appears in the above-identified patent and that said Letters Patent is hereby corrected as shown below:

On the title page, Item (73), the Assignee's information is incorrect. Item (73) should read:

-- (73) Assignee: Ricoh Company, Ltd., Tokyo (JP) --

Signed and Sealed this
Eighteenth Day of October, 2011

David J. Kappos

David J. Kappos
*Director of the United States Patent and Trademark Office*